US005436537A

United States Patent [19]

Hiramoto et al.

[11] Patent Number: 5,436,537

[45] Date of Patent: Jul. 25, 1995

[54] CIRCULAR ACCELERATOR AND A METHOD OF INJECTING BEAMS THEREIN

[75] Inventors: Kazuo Hiramoto, Hitachiota; Junichi Hirota, Hitahci; Masatsugu Nishi, Katsuta, all of Japan

[73] Assignee: Hitachi, Ltd., Japan

[21] Appl. No.: 302,384

[22] Filed: Sep. 8, 1994

Related U.S. Application Data

[63] Continuation of Ser. No. 833,660, Feb. 11, 1992, abandoned.

[30] Foreign Application Priority Data

Mar. 19, 1991 [JP] Japan ..... 3-054338

[51] Int. Cl.[6] ..... H05H 7/08

[52] U.S. Cl. ..... 315/507

[58] Field of Search ..... 315/500, 505, 502

[56] References Cited

U.S. PATENT DOCUMENTS

| | | | |
|---|---|---|---|
| 4,783,634 | 11/1988 | Yamamoto et al. | 328/235 |
| 4,812,774 | 3/1989 | Tsumaki et al. | 328/235 X |
| 4,988,950 | 1/1991 | Nakayama et al. | 328/235 |

*Primary Examiner*—Sandra L. O'Shea
*Assistant Examiner*—Vip Patel
*Attorney, Agent, or Firm*—Evenson, McKeown, Edwards & Lenahan

[57] ABSTRACT

A circular accelerator for charged particles in which by accelerated damping of the betatron oscillation, that is, a rapid reduction in a beam size through enhancing the radiation damping after the beam injection, a short period of time injection can be accomplished, and also a large current is capable of being stored through repetition of such beam injections.

30 Claims, 12 Drawing Sheets

CIRCULAR ACCELERATOR AND A METHOD OF INJECTING BEAMS THEREIN

This application is a continuation of application Ser. No 07/833,660, filed on Feb. 11, 1992 now abandoned.

BACKGROUND OF THE INVENTION

The present invention relates to a circular accelerator for accelerating charged particles such as electrons, protons and the like, and more specifically to a circular accelerator which is capable of injecting a large quantity of charged particles in a short period of time, and storing a large current therein.

In a prior art circular accelerator, a beam having a large quantity of charged particles is injected into a beam duct which defines an orbital trajectory, to orbit therein. The injected beam emits a light of emission during its orbit, and its beam size tends to reduce, a phenomenon which is called radiation damping. Because of a varied degree of this radiation damping, depending on the energies of charged particles, prior art circular accelerators are classified roughly into two types in terms of the energy at injection: those in which the energy of charged particles is less than 100 Mev, and those in which the energy of charged particles is 100 Mev or more. In the case of former (more particularly when the energy is less than 50 Mev), because of the relatively small radiation damping effect, it takes a great time for a beam size to be reduced. (For example, at 15 MeV the radiation damping time constant $\iota$ required for the beam size to become 1/e is approximately 750 s; while at 50 MeV it is 20 s.) Therefore, in most prior art circular accelerators, a beam is injected once for a given period of time, and is accelerated thereafter as described in the Monthly Physics "Accelerator Physics (3)" pp 4.–11 (1985.1).

In another prior art circular accelerator, after a beam is injected, it is accelerated to increase its energy, thereby enhancing the radiation damping effect, and the beam energy is then decreased to an initial condition once again to repeat injection, thereby permitting multiple injections of charged particles, and enabling a large current to be stored therein as set forth in the Ishikawajima Harima Technical Report Vol. 30 No. 5 pp 321–323 (1990.9).

It should be noted that the latter device has a large energy even at the time of injection. Therefore, a substantial radiation damping effect may be expected from the start. Hence, in a third approach after waiting for a reduction in a beam size for a given period of time following the injection, another injection is repeated, so as to obtain a large current.

An important disadvantage of the first of the above prior art devices is that a large current cannot be obtained because as a practical matter only one injection is permitted due to the prolonged radiation damping time required. According to the second prior art device referred to above, the number of repetitions of the injection is at most three times, and a large current is also unlikely to be obtained. In addition, it takes a long time (several minutes) for injection because of the prolonged acceleration and deceleration required. In particular when a superconductivity electromagnet is utilized as a bending electromagnet, its acceleration and deceleration will be prolonged even more. The third prior art approach mentioned above, raises problems that it cannot be applied when injection energy is low, and that, in order to increase the injection energy, the use of a linear accelerator having a length of approximately 20 m, or a microtron is required. The former requires a large-scale system, and the latter requires eventually a lot of time because of the limited number of charged particles permitted to be injected per injection.

SUMMARY OF THE INVENTION

An object of the present invention is to provide a circular accelerator and an injection method capable of reducing the period of time required for injection.

Another object of the present invention is to provide a circular accelerator and an injection method capable of injecting a large current in a short time even when injection energies of charged particles are less than 50 Mev.

Another object of the present invention is to provide a circular accelerator which is compact and is capable of injecting a large current.

In order to accomplish the above-mentioned objects, means are provided for enhancing the radiation damping effect, which permits the beam size to be reduced by emitting light of or electromagnetic waves from the beam in orbit. (Hereinafter, emission of light or electromagnetic waves, all included, will be referred to as a light of emission.) This can be accomplished specifically in one or more of the following three ways. A first technique is to increase the magnetic field intensity in the electromagnet, specifically that which adjusts or deflects the beam orbit, during injection compared with the field intensity after completion of injection. A second technique is to lengthen the center passage course during injection (relative to after completion of injection) of a beam passing through the electromagnet(s), particularly that which adjusts or deflects the orbit of the beam. In particular, it is preferable to lengthen the passage with a decreasing beam energy at the time of injection, and also to lengthen the passage with an increasing beam energy after the completion of injection. In a third technique, an apparatus is provided in a straight portion of an orbit for bending the beam in zigzag directions, such apparatus being activated at the time of injection.

Other objects, advantages and novel features of the present invention will become apparent from the following detailed description of the invention when considered in conjunction with the accompanying drawings.

DETAILED DESCRIPTION OF THE DRAWINGS

Figure 1:
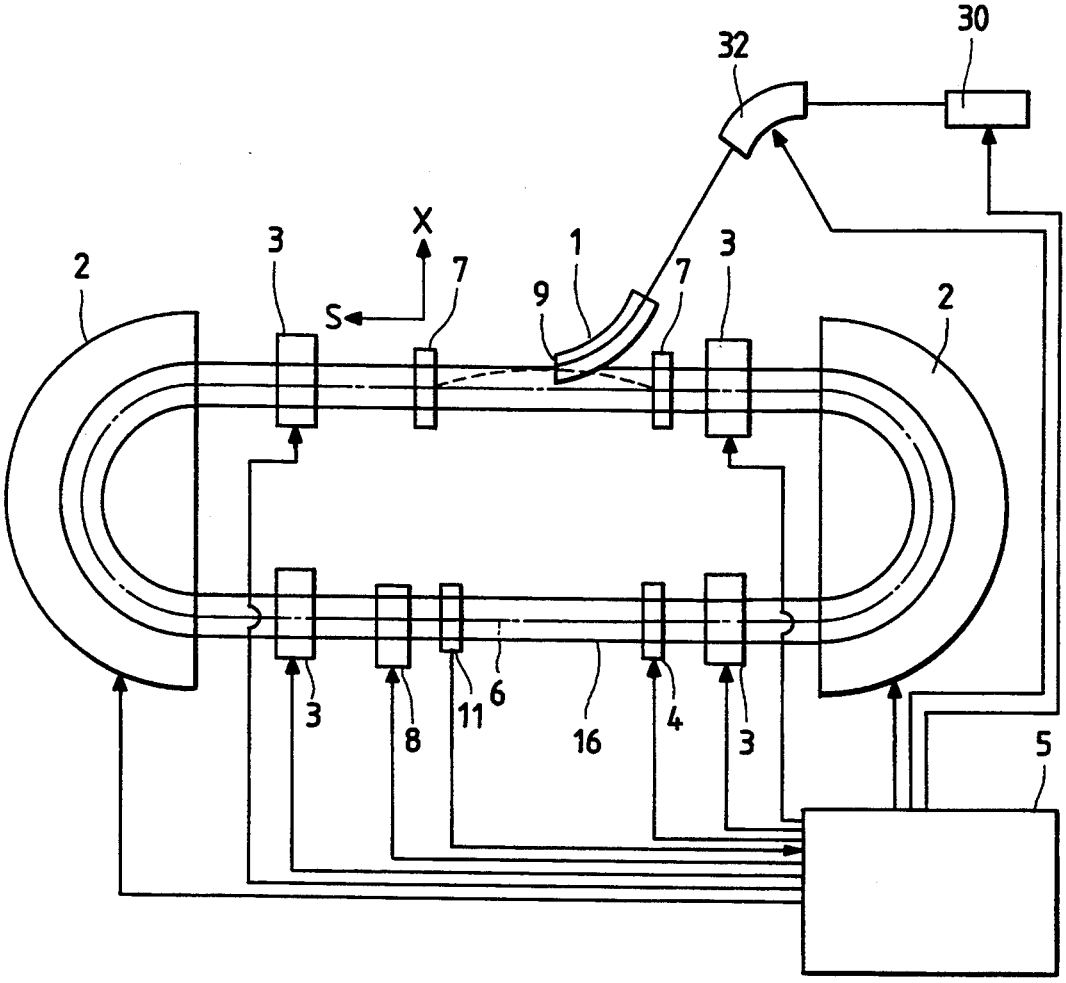
FIG. 1 shows a circular accelerator in a first embodiment of the invention.
Figure 2A:
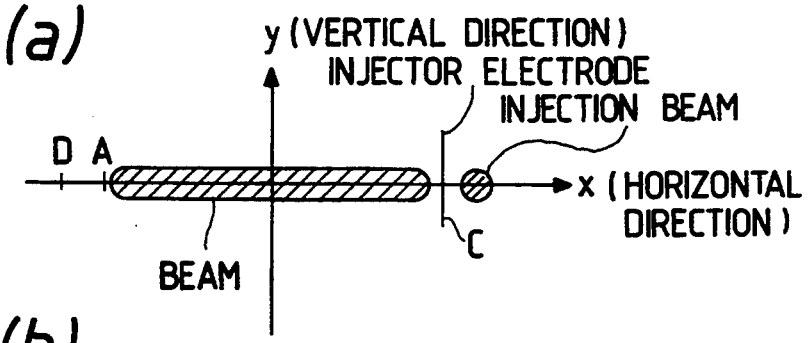
FIG. 2 illustrates changes in beam size at the site of an injector.
Figure 2B:
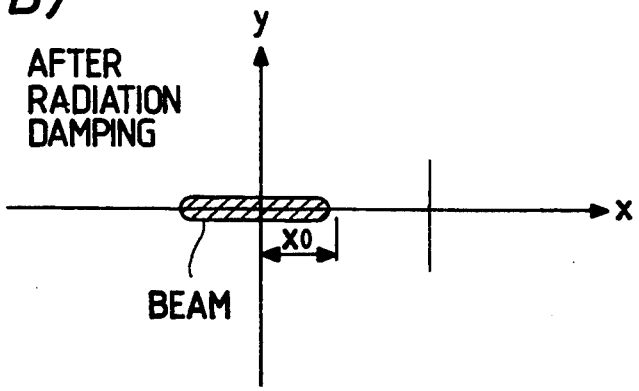
Figure 2C:
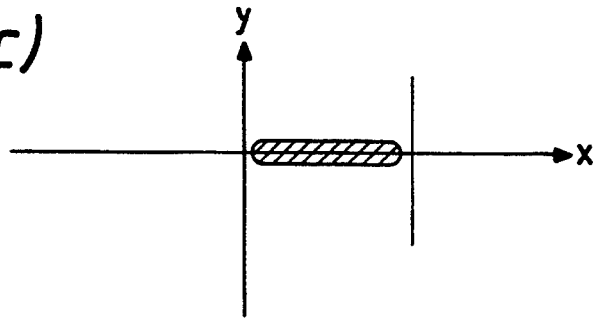
Figure 2D:
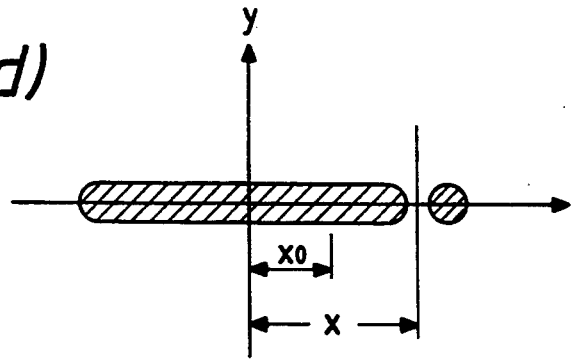

FIG. 1 shows a preferred embodiment of a circular accelerator according to the present invention. (It should be noted that although the orbital path in the embodiment in FIG. 1 is not actually a circle as such, consisting rather of semicircular and straight segments, such an accelerator is customarily referred to as a circular accelerator, which terminology is used herein.) The circular accelerator comprises a prestage accelerator 30, a beam injector 1 for injecting a beam 9 having multiple charged particles from the prestage accelerator 30 through a beam transport system 32 into a beam duct 16, a high frequency acceleration cavity 4 for supplying energy to the injected beam 9, bending electromagnets 2 for deflecting the beam direction, four-pole electromagnets 3 for converging the beam, a bump electromagnet 7 for controlling the beam orbit at the time of injection; and a control unit 5 for controlling and supplying power to these apparatuses and components.

Hereinafter, a circular orbit (including the embodiment of FIG. 1, as explained above) for each of the charged particles will be referred to as a closed orbit, and a center portion of closed orbits of the charged particles (defined by the bending electromagnets 2 and 4-pole electromagnets 3 during their orbit), namely the center of the beam, will be referred to as a center closed orbit. Typically, these orbits will be determined as follows. An orbital path in the bending electromagnet 2 is determined by the balance of a centrifugal force acting on the charged particles and a centripetal force exerted thereon. Hence, assuming the magnetic field intensity in the bending electromagnet 2 to be constant, when energy is added in the high frequency acceleration cavity 4, the beam tends to take an outer orbit because the centrifugal force of the charged particles becomes prevalent. There are also provided two pairs of four-pole electromagnets 3, each pair of which is disposed in a straight line portion of the orbit, and serves to define the orbital path of the beam between the respective centers of the pair of four-pole electromagnets. The exact path followed by the closed orbit is actually determined by the combined effect of the above two operations. Further, as the charged particles travel along a center closed orbit they generally undergo oscillations, referred to as betatron oscillation. Still further, there exist orthogonal coordinates with x and s axes as shown in FIG. 1, the s axis of which indicates the orbital direction of the beam. A y direction is defined as an axis perpendicular to the xs plane.

The number of charged particles, (that is, current value) capable of being injected in the circular accelerators referred to above, will be explained in the following with reference to the multi-turn injection method set forth in the prior art first referred to above. The number of charged particles that can be injected therein depends upon the width AC of an xy cross-section of the beam duct 16 shown in FIG. 2. (Typically, charged particles are injected in the form of a beam comprising a large quantity of such particles. Thus, unless otherwise described, the term beam will be used hereinafter in place of charged particles.) According to the multi-turn injection method, bump electromagnets 7 gradually shift the center closed orbit of an injected particle beam (in the area between the bump electomagents) from an outer course to an inner course, as shown in FIG. 1, so that the beam in orbit may be dispersed along the line AC in FIG. 2. Once it is fully dispersed along the line AC, no further injection is permitted. That is, charged particles exceeding a certain allowable degree cannot be injected, the width extent of the beam at which time being called a beam size. However, when the beam size is reduced to provide enough space along the line AC, other charged particles can be injected therein.

The present invention seizes this point. Namely, the following control steps are repeated in order to permit an increase in the injected current: first, inject a beam; second, suppress the amplitude of its betatron oscillation so as to reduce the beam size; third, inject still another beam into an evacuated space, and once again reduce the beam size. Further by accelerating the reduction in the beam size, the injection time can be shortened accordingly. With a view to shortening the injection time, even a single operation without repeating the above control steps will be also effective. Further, this process for reducing the beam size may be effected, not only after each injection, but from the start of the first injection. In this case, such means for reducing the beam size is to be released after the completion of the injection. Hereinabove, what is termed as the injection time includes a period of time elapsed in the entire control or operation sequence necessary in the injection, from the beginning to the end, including the time during which the beam is injected.

The means according to the present invention differs from the second prior art approach referred to previously, in that it can be effected without accelerating the beam as described above, and can also be effected by accelerating the beam during the injection. When radiation damping occurs and the beam loses energy, its size is reduced accordingly. It is possible for the reduced beam to recover to an initial energy state in the high frequency acceleration cavity if desired. When supplied energy in the high frequency acceleration cavity, the beam size increases somewhat; however, in general, the beam size is likely to be reduced. Hence, the beam is circulates in the beam duct at a substantially constant energy.

Beforesdescribing the preferred embodiments of the present invention, an explanation of the radiation energy and other parameters will be provided. As set forth above, a beam orbiting in a beam duct undergoes a betatron oscillation, and emits energy while traversing through a magnetic field, thereby damping the betatron oscillation. This damping of betatron oscillation reduces the beam size. A damping time constant of the beam size (a period of time elapsed until the beam size becomes 1/e through emission of radiation from charged particles) agrees with an oscillation damping time constant of the betatron oscillation (likewise, a period of time elapsed until an amplitude becomes 1/e). The above-mentioned means of the present invention is contemplated for reducing the damping time constant of the betatron oscillation. The energy U of the beam dissipated while it passes through a bending electromagnet and multi-pole electromagnets providing a magnetic field having at least four poles, is expressed by the following equation.

$$U \propto \int BE^3(1+\eta \cdot \Delta E/E)ds \quad \text{(Eq. 1)}$$

where,

B: magnetic field intensity at a position where the beam traverses in the electromagnet $\eta$: dispersion function E: beam energy $\Delta E$: deviation in energy from the beam in a center closed orbit ds: a unit distance along the S-axis (FIG. 1) at $\Delta E=0$, or along the center closed orbit of the beam Since an energy U which a beam loses is proportional to magnetic field intensity B in an electromagnet, to beam energy $E^3$ and to the integral distance, an increase in any of these parameters tends to increase the rate of energy dissipation by the beam. A first means according to the invention relates to the magnetic field intensity B in the electromagnet, and a second -means relates to the integral distance. By intensifying the magnetic field in the electromagnet, a stronger light of emission is obtainable because the direction of the beam is bent proportionately more, and greater energy is therefore dissipated.

It will be appreciated from equation 1 that with a decreasing beam energy E due to the emission of energy, the rate of dissipation of energy becomes rapidly smaller. Therefore, if the energy is increased in a high frequency acceleration cavity or the like even after the energy dissipation, freed from the energy (momentum) dependency, the damping time constant of the betatron oscillation can be decreased significantly.

With respect to the first means according to the invention, depending on the intensification of the magnetic field in the electromagnet, the beam undergoes a change in its direction, thereby emitting a correspondingly intensified light of emission. That is, the energy to be dissipated becomes proportionately greater. As a result, the beam size can be reduced in a short period of time. On the other hand, according to the second means of the present invention, since the beam loses energy by emission of light, it is possible to increase the amount of energy thus dissipated by prolonging the period of time for emitting light, thereby decreasing the beam size in a short period of time.

Finally, in a third means of the present invention, an apparatus for bending the direction of the beam in orbit is installed in a straight line portion and activated at the time of injection, thereby stimulating a light of emission and accelerating the radiation damping effect. If there is already provided a wiggler or undulator along the orbital course, through activation of such apparatus, the radiation damping can be accelerated to reduce the beam size. If, however, no wiggler or undulator is provided, the same effect can be attained through employment of such apparatus and its operation.

Preferred embodiments of the present invention will be described in detail in the following.

FIG. 1 shows a preferred embodiment of the first means of the present invention. In this embodiment, independently of four-pole electromagnets 3 which define a normal closed orbit, there is installed another four-pole electromagnet 8, somewhat offset from the center closed orbit, which implements the effect of the present invention. In the accelerator of FIG. 1, electrons having energies of approximately 50 MeV are injected and accelerated from 50 Mev to 600 MeV in electron energy eventually to be stored in orbit therein. As the disposition and schematic operation of FIG. 1 have been described already, the description here will be focused in particular on the operation of the apparatus at the time of beam injection.

Although the beam injected from the injector 1 undergoes betatron oscillations during orbit, its orbital course is stabilized by two pairs of four-pole electromagnets 3, and at the same time it is deflected in the two bending electromagnets 2. In the high frequency acceleration cavity 4, the beam is either accelerated or decelerated to maintain its orbit. In most cases, a curve obtained by plotting center positions in the beam duct along the accelerator coincides with a center closed orbit 6 of the beam. The bump electromagnet 7 which has been employed in the prior art multi-turn injection method, is used for shifting the center closed orbit of the beam during the beam injection. The bending electromagnets 2, four-pole electromagnets 3 and bump electromagnets 7 are disposed in a manner so that each of their centers coincides with the beam duct center. The four-pole electromagnet 8, which implements the present invention, is utilized to maintain the damping time for the betatron oscillations of the beam, and (as noted previously) is situated at an offset from the center orbit 6 of the beam.

Figure 4:
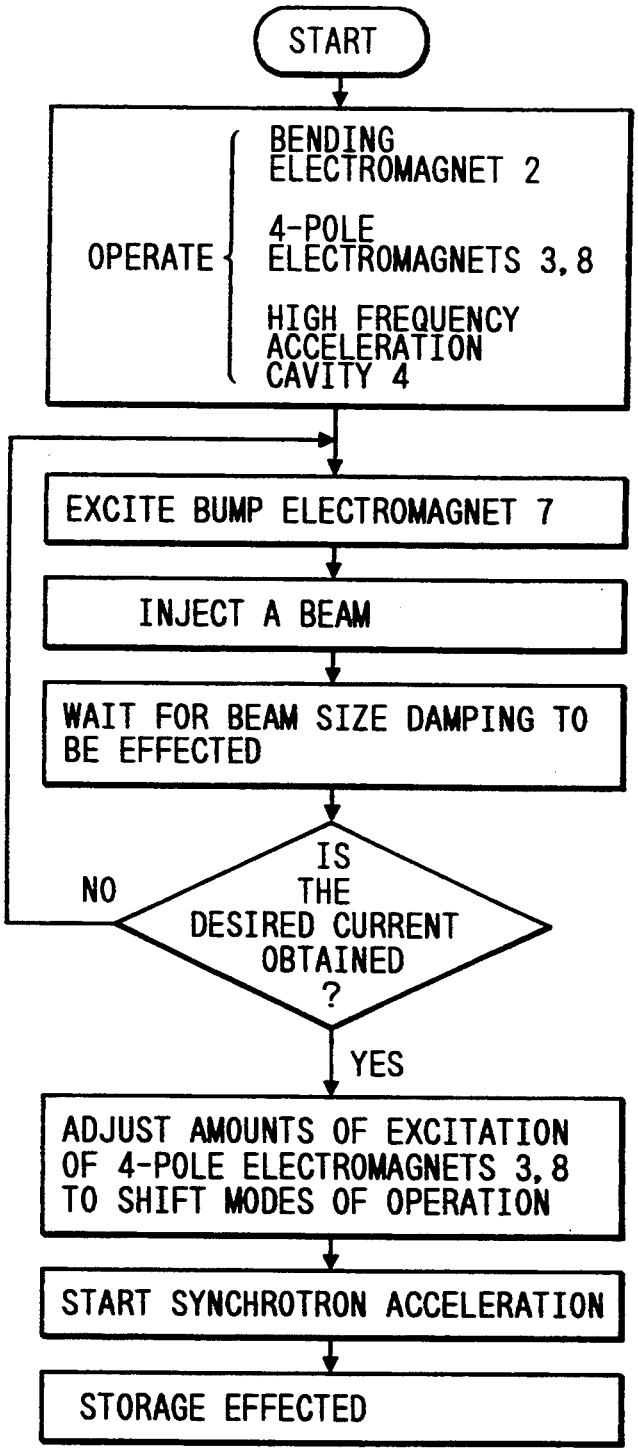
FIG. 4 shows a method of operation of an accelerator according to the invention.

The method of operation of this accelerator is set forth in FIG. 4, and is controlled by the control unit 5. Typical synchrotron accelerators such as this embodiment generally have three modes of operation. The first mode of operation is a step of injecting a beam from the prestage accelerator 30 into the beam duct 16. After the completion of the injection the second mode includes a procedure to accelerate the beam, which is termed "synchrotron acceleration". The energy of the beam is increased in the high frequency acceleration cavity 4, while at the same time excitation of the bending electromagnets 2 is increased so as to maintain a balance between a centrifugal force of the beam and a centripetal force exerted on the beam by the bending electromagnets 2 thereby maintaining the beam in orbit within the beam duct. The third mode is a storage mode in which the acceleration is interrupted when a desired energy level (in this case, 600 MeV) is reached, to maintain the energy level constant. In the storage mode, a light of emission is directed outward to be utilized in a lithographic processing of semiconductors or the like.

Operation of the accelerator according to the invention at the time of beam injection will now be described in further detail. Prior to beam injection, the bending electromagnets 2 and four-pole electromagnets 3, 8 are set so as to provide a condition under which the beam can orbit stably. More specifically, excitation of the four-pole electromagnet 8 is approximately five times as large as that of the four-pole electromagnets 3. Thus, at the time of beam injection, a damping effect on the beam size is already provided. Further, the high frequency acceleration cavity 4 is adjusted in advance to supply sufficient energy to assure that the beam orbits stably.

Figure 5:
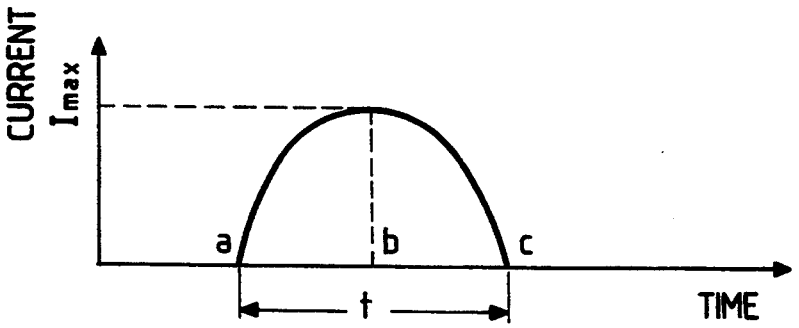
FIG. 5 shows current variations in a bump electromagnet.

Next, the bump electromagnet 7 is excited with a current having a waveform as shown in FIG. 5. The pulse length t is set at approximately 50 times as large as an orbit time per round of the beam. With reference to FIG. 5, injection of a beam through the injector 1 is commenced at a time b when the excitation of the bump electromagnet 7 is maximum, and is completed at a time c when the excitation becomes zero. At time b, when excitation of the bump electromagnet 7 is very large, deflection of a center closed orbit between the bump electromagnets becomes correspondingly greater, and the center closed orbit between the bump electromagnets is shifted outward relative to the designed closed orbit 6. The beam injected from the injector 1 thus travels in orbit in a betatron oscillation with amplitudes corresponding to the distance between the injector electrode tip 9 and a center closed orbit at the electrode tip site. Hence, by shifting the center closed orbit between the bump electromagnets, and by providing varied amplitudes to the betatron oscillation, the beam is injected between AC as shown in FIG. 2(*a*). Afterwards, this state is maintained for a certain period of time in order to effect radiation damping; for example, approximately ½ of the radiation damping time constant. In this embodiment, if this time is set approximately at 0.5 s, the amplitude of the betatron oscillation will decrease 50%, thereby decreasing the beam width by 50% as shown in FIG. 2(*b*).

Figure 3:
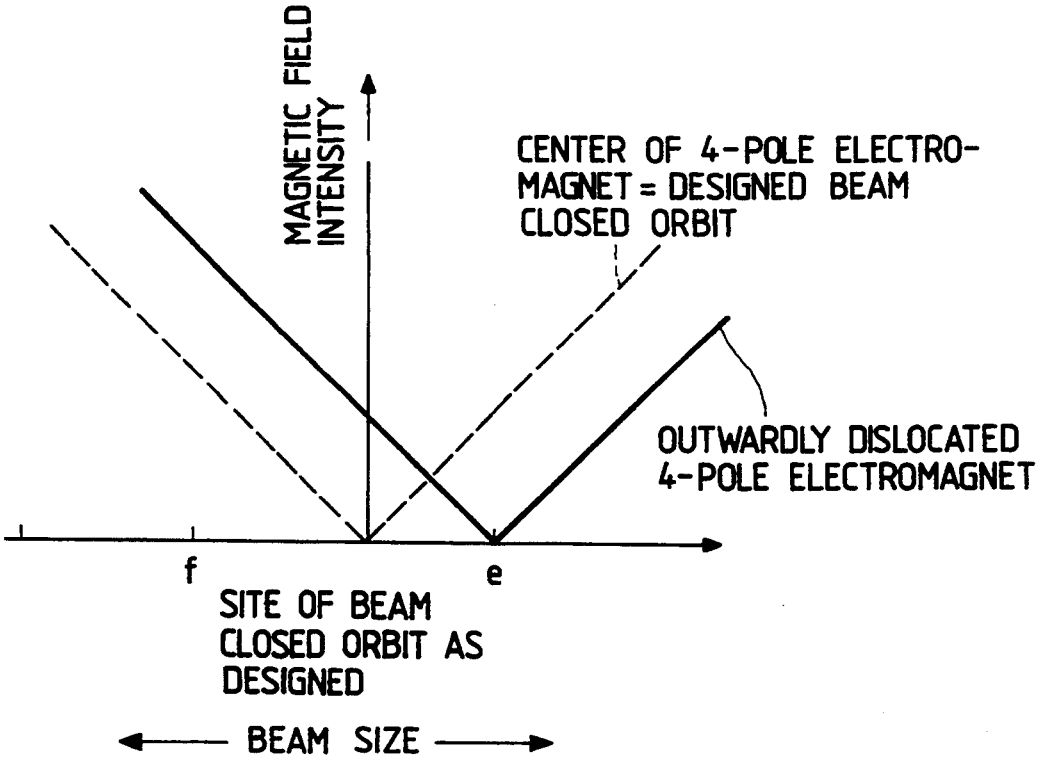
FIG. 3 is a graphic depiction of beam width vs. magnetic field intensity of a four-pole magnet for a charged particle beam in an accelerator.

FIG. 3 illustrates the relationship between magnetic field intensity and beam size for the four-pole electromagnet 8, which is shifted outwardly, in comparison with the four-pole electromagnets 3 which is in place on the designed closed orbit for the beam, as disposed normally. The beam orbits undergoing a betatron oscillation confined within a given beam width, and always traverses between e–f (FIG. 3), which represents the area within the four-pole electromagnet 8 in which the desired damping effect is achieved. The distance between e and f can be rendered larger in comparison with the beam width, and the probability of the beam's passing therebetween becomes larger accordingly. As the beam passing between ef is subjected to a stronger magnetic field, it is bent to a correspondingly greater extent, thereby emitting even more light of emission, and as a result, the beam size is reduced. The smaller the beam size becomes, the greater the probability of its passing between ef becomes, hence further enhancing the radiation damping effect. Furthermore, in this embodiment, as the magnetic field intensity of the four-pole electromagnet 8 is set approximately five times greater than normal, its effect is still further enhanced.

After the beam size is reduced to 50%, the bump electromagnet 7 is excited once again with a current of FIG. 5. During time ab (FIG. 5), the injected beam already in orbit is gradually shifted outwardly relative to its center closed orbit, toward the injection point 9 of the injector 1 (FIG. 2 (c)). The maximum current for the bump electromagnet is adjusted to prevent the injected beam already in orbit from colliding with the injector 1 and being lost. Thereafter, a beam is injected during bc in FIG. 5 to yield a state of FIG. 2(*d*).

The beam quantity or current value which can be injected into the beam path where a beam is already in orbit is proportional to the cross sectional area of the beam path which is available to receive additional particles. Assuming as noted above, that damping is permitted to proceed until dimensions of the beam currently in orbit are decreased by one half, then the injectable beam quantity can be expressed as follows in terms of the relationship in FIG. 2(*d*).

$$(x^2-X_o^2)/x^2=\tfrac{3}{4}\text{I (assuming } x_o=\tfrac{1}{2}x)$$

As the value $x_o$ is considered to be approximately equal at each injection (that is, ½x), an injected current $I_N$ after repeating the above sequence N times, by assuming the first injection current as $I_1$, is expressed as $(1+\frac{3}{4}N)I_1$. As $I_1$ is capable of taking a value of approximately 200 mA, by repeating the injection about a dozen times, a current value of 2 A can be obtained. The number of injections required for a desired current value may be determined by measuring an actual beam current through the beam current monitor 11 shown in FIG. 1. In the above example total injection time is about 6 s. That is, the damping time per cycle is approximately 0.5 s (in comparison with which, a time for the injection itself is negligibly small: on the order of ms), which is repeated twelve times. With a beam having an injection energy of, for example, 15 MeV (the damping time of which per cycle can be suppressed to approximately 20 s at most), it is possible to attain a current of several A in approximately three minutes.

After the completion of the injection mode, the beam is accelerated to a high energy range and stored. Simply increasing the excitation in the related electromagnets during the acceleration is problematic, however, since it is also necessary to increase the excitation of the four-pole electromagnet 8 by a corresponding amount, which becomes extraordinarily large. Hence, before entering the acceleration and storage mode, the excitation of the four-pole electromagnet 8 is decreased (FIG. 4), and the excitation of the other four-pole electromagnets 3 is adjusted for maintaining a constant tune, that is, a constant number of betatron oscillations per revolution, so as to alter the operational conditions from one in which the damping time of the betatron oscillations of the beam is suppressed, to another under which, though the damping time of the beam increases, a more stable acceleration is facilitated.

In the above description, the four-pole electromagnet 8 is shown as being offset outwardly. A preferred offset direction is such that, after emission of energy, the deflected beam tends to reinforce the magnetic field of the four-pole electromagnet, which direction is determined by a value of the dispersion function $\eta$, which is controlled by four-pole magnets 3. The dispersion function $\eta$ in turn is itself a function of s (FIG. 1), that is, position along the direction of orbit, and is defined by equation 2 as follows.

$$\eta(s)=x(s)/(\Delta p/p) \qquad \text{(Eq. 2)}$$

where;

x(s): deviation at position s of a beam closed orbit from the center closed orbit (designed closed orbit). Outside is positive (refer to FIG. 1)

p: momentum of a beam in orbit along the center closed orbit

Δp: deviation in momentum of an object beam from p.

The dispersion function $\eta$ indicates a degree of deflection or shift of a closed orbit with respect to a deviation in momentum. A positive value of $\eta$ indicates, when the momentum is large, that the beam is in an outer path of orbit, and when the momentum is small that the beam is in an inner path of orbit. A negative value of $\eta$ indicates a reverse case of the above. As a momentum of beam particles is constant and undergoes a betatron oscillation, $\eta$ may take a value either positive or negative depending on its position. Because the betatron oscillation is mainly controlled by the four-pole electromagnets 3, it is possible to use them to select those positions in the orbit for which $\eta$ is to be set positive or negative. The above embodiment shows a case where the four-pole electromagnet 8 is disposed so as to render $\eta$ positive. Thus, when the beam reduces its momentum (energy), and $\Delta p$ shifts in the negative direction, followed by an offset of position x also in the negative direction, it is subjected to even stronger magnetic field in the four-pole electromagnet 8 per orbit, thereby yielding an enhanced damping effect on the light of emission. Generally, as the beam is supplied energy in the high frequency acceleration cavity 4, the beam size is likely to be reduced, not undergoing divergence.

As set forth hereinabove, this embodiment of the present invention offers an advantage that a large current can be injected in a short period of time. Further, this invention can be applied to a circular accelerator having a high injection energy successfully to reduce its injection time. In addition, although the four-pole electromagnet 8 has been described as being excited at the start of the injection, it may be excited at each time of injection, with the same effect. Also, in order to accelerate the damping of betatron oscillations of the beam, the four-pole electromagnet has been employed; however, a multi-pole electromagnet of six poles or more may be substituted with the same effect.

Figure 6:
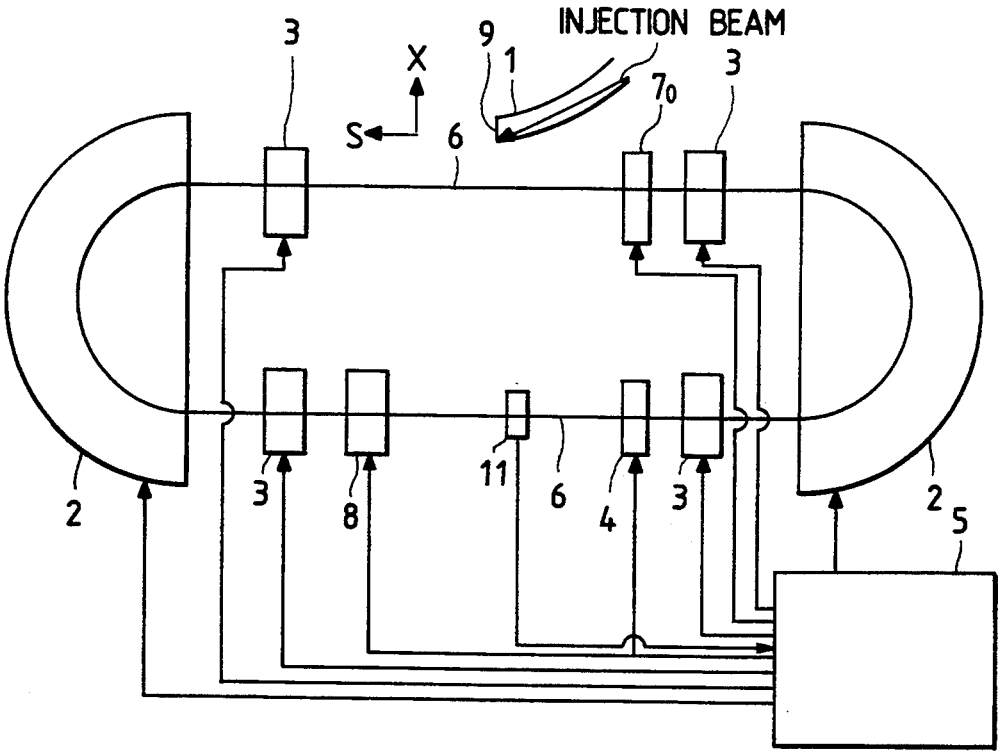
FIG. 6 shows a circular accelerator of a second embodiment of the invention.

FIG. 6 shows a second embodiment of the first means according to the present invention, in which a multi-pole electromagnet 8 having four or more poles is disposed so that its center agrees with a center closed orbit 6, and a different injection technique is utilized. In this case, it is necessary to make sufficiently large the amount of excitation as shown by broken lines in FIG. 3 in the four-pole electromagnet. Then, as the direction of the beam is bent greatly when passing through a position away from the center closed orbit, it produces a more intensified light of emission, thereby accelerating the radiation damping, and yielding the same effect as the first embodiment of the present invention. Further operation of the accelerator, except for method of injection control, are the same as in FIG. 4.

It is important to note that the method and apparatus according to the invention, in which the radiation damping effect is speeded up in order to achieve a reduction of the beam size, is independent of the particular injection technique which is utilized, and can be practiced with any type of injection method. As an example, with respect to the embodiment of FIG. 6 in particular, the technique described below is used.

In the first embodiment, described above, the shifting of the center closed orbit in the area between the bump electromagnets is used to inject the beam between AC as shown in FIG. 2(*a*). In the embodiment of FIG. 6, on the other hand, the same function is accomplished by accelerating or decelerating the beam. When the beam is first injected into the accelerator, it has a width as shown in FIG. 2(*a*), which is determined by the amplitude of the betatron oscillations. The beam circulating with betatron oscillation is accelerated or decelerated in the direction of the circulation by receiving energy from the closed orbit shifting apparatus $7_0$. The deflecting radius of the accelerated beam effected by the bending magnet 2 therefore increases, and the closed orbit of the accelerated beam moves toward outside in FIG. 6 (toward the injector electrode side in FIG. 2(*a*)), while the closed orbit of the decelerated beam moves toward inside in FIG. 6 (the opposite side to the injector electrode in FIG. 2(*a*)). Therefore, the closed orbit of the beam can be changed by acceleration and deceleration. As a result, the closed orbit of the beam moves in a horizontal plane including the s and x axes in FIG. 6. Hence, the beam is allowed to pass the linear region AC in FIG. 2.

Figure 7:
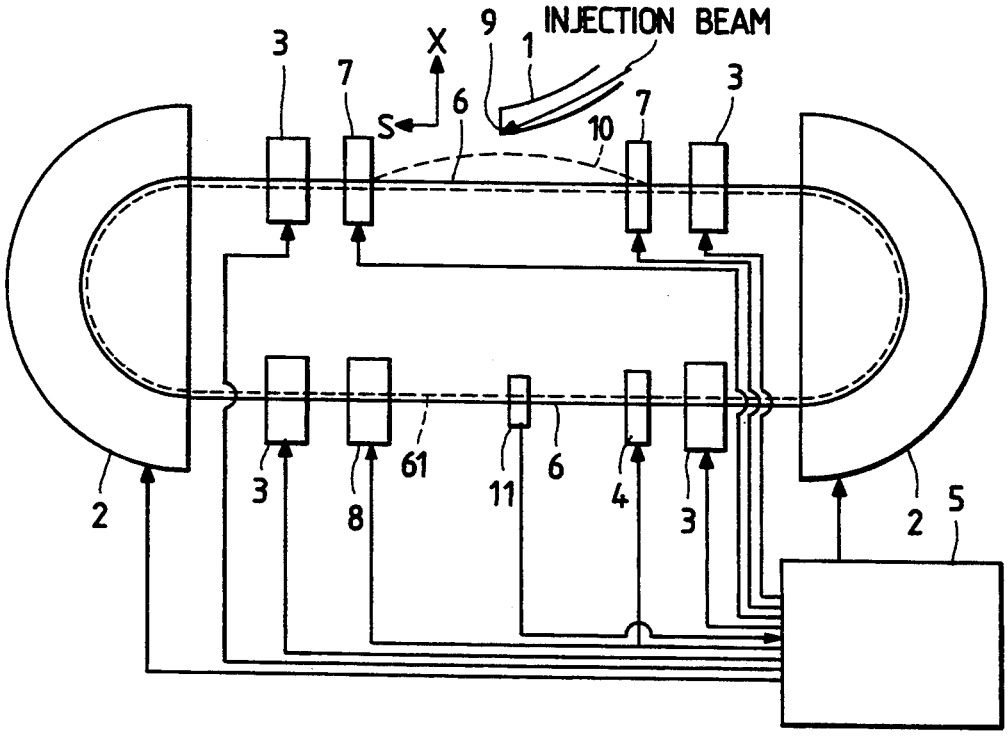
FIG. 7 shows a circular accelerator of a third embodiment of the invention.

FIG. 7 shows a third embodiment of the first means of the invention, which is the same as that of the second embodiment in FIG. 6, except for the injection method which is used, and the manner of forming a beam center closed orbit at the time of injection. In the embodiments heretofore, a center closed orbit at the time of injection is adjusted to agree with the design center closed orbit. In this embodiment, however, the center closed orbit at the time of injection is altered somewhat as shown by broken lines 61 in FIG. 7. The direction of shift may be either inward or outward, but is preferably determined by the relationship between the energy dispersion $\eta$ and the related four-pole electromagnet as described in the first embodiment. In this embodiment, the case of an inward shift will be explained. When the center closed orbit is shifted inwardly at the time of injection, since the center closed orbit and the center of the four-pole electromagnet do not coincide, a relative relationship the same as described in the first embodiment can be obtained, with the same effect as in the preceding embodiment. This inward shift can be implemented by varying the balance between the amount of energy supplied in the high frequency acceleration cavity 4 and the level of excitation for a bending electromagnet 2, as explained previously with respect to the synchrotron acceleration.

Figure 8:
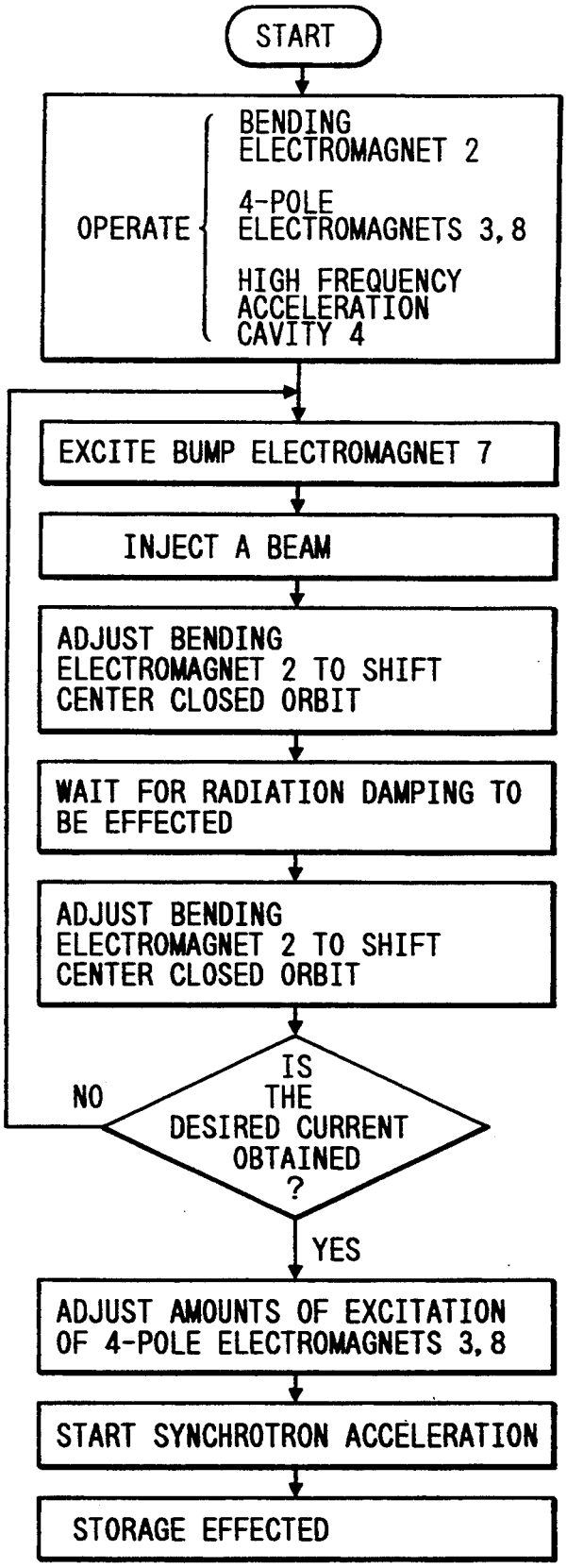
FIG. 8 is a block diagram showing a method of operation of the third embodiment of the invention.

The block diagram of FIG. 8 illustrates the operation of the accelerator according to the invention in which the centripetal force is increased by increasing excitation in the bending electromagnet 2 so as to deflect the beam inwardly. As in previous embodiments, this process is controlled by control unit 5. As shown in FIG. 8, once a beam is injected by controlling a bump electromagnet 7, the excitation of the two bending electromagnets 2 is varied so as to shift the beam center closed orbit from an orbit trajectory 6 to a position as shown by broken lines 61 in FIG. 7. This produces the same effect as when the center of the electromagnet 8 in the first embodiment of the invention is shifted from the center of the beam, thereby effecting the damping of the betatron oscillation in a very short period of time. After the betatron oscillation is sufficiently damped, the beam center closed orbit restores its original course, and another beam is injected by controlling the bump electromagnet 7. By repeating this procedure until a predetermined value for the injected beam current is obtained, a larger current can be injected in a shorter period of time. Afterward, as in the first embodiment of the invention, the excitation of the four-pole electromagnets 3 and 8 is adjusted so as to assume a mode of operation whereby acceleration is facilitated and the beam is stably stored.

In the above explanations, the variation of the excitation of bending electromagnets 2 is repeated at each respective injection. However, the same effect may be accomplished by shifting the center closed orbit from the beginning, and restoring the initial course of orbit after its completion. In this manner, with reference to FIG. 2, a range permitted for injection can be extended from line AC to line DC, thereby accommodating an even larger current.

Next, a case where a beam center closed orbit is shifted by means of a high frequency acceleration cavity is described. Suppose that a sinusoidal wave form energy having a constant frequency f is supplied to the high frequency acceleration cavity 4. When there exists a certain relationship between the phase of the sinusoidal wave and the phase of the beam in orbit, the beam travels a center closed orbit. When the frequency increases, the phase of the sinusoidal wave advances, resulting in a decrease in energy supplied to the beam. Hence, the centrifugal force in the bending electromagnets decreases, resulting in a relative increase in the centripetal force due to the bending electromagnets 2, thereby shifting the beam center closed orbit in the inward direction. The relationship between a frequency shift quantity $\Delta f$ in the high frequency acceleration cavity 4 and an associated shift or dislocation $\Delta x$ of the center closed orbit will be indicated below. The following equation is obtained between momentum p of the beam and frequency f of the high frequency acceleration cavity by using a constant $\alpha$ which is termed as a momentum compaction factor.

$$\Delta p/p = -(1/\alpha)\cdot\Delta f/f \quad \text{(Eq. 3)}$$

When frequency shift quantity $\Delta f=0$, that is, when the frequency is f, the center closed orbit has $x=0$, hence by substituting equation 3 in equation 2 and rewriting, the displacement $\Delta x$ due to the high frequency acceleration cavity is expressed by equation 4.

$$\Delta x = -(\beta/\alpha)\cdot\Delta f/f \quad \text{(Eq. 4)}$$

As explained above, a deviation $\Delta x$ of the center closed orbit can be determined quantitatively from equation 4, and the same effect as by the bending electromagnet can be obtained.

Thus, in this embodiment of the invention, control unit 5 as shown in FIG. 7 controls the frequency f of the energy supplied by control unit 5 to high frequency acceleration cavity 4, to shift the center closed orbit in the desired manner.

Figure 9:
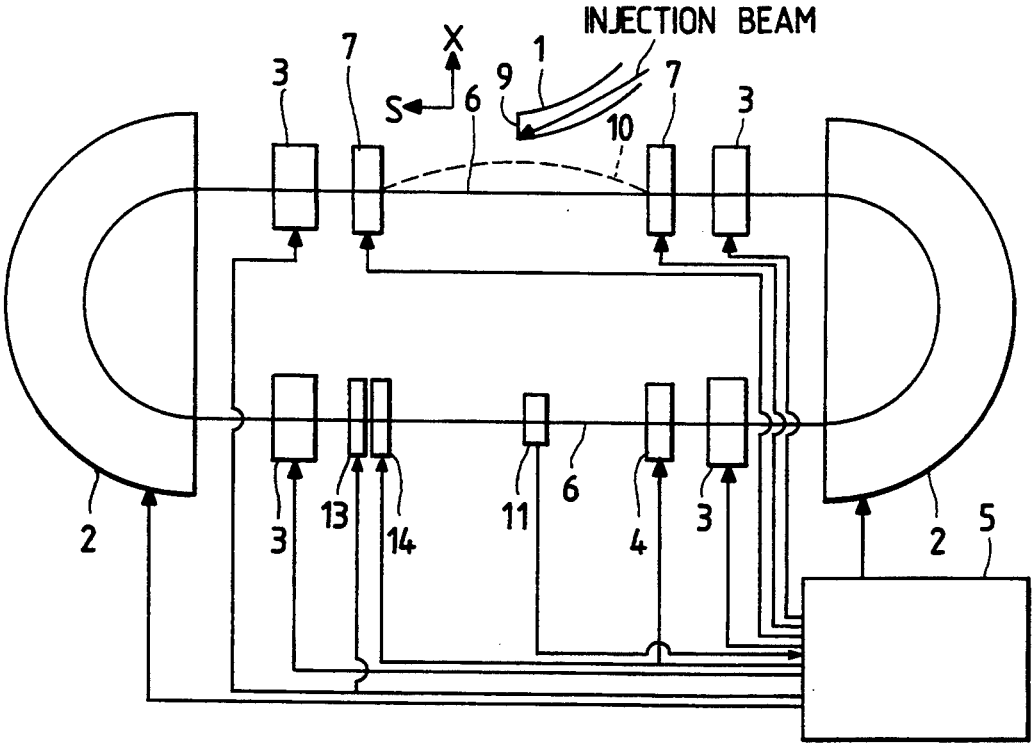
FIG. 9 is a circular accelerator of a fourth embodiment of the invention.
Figure 10:
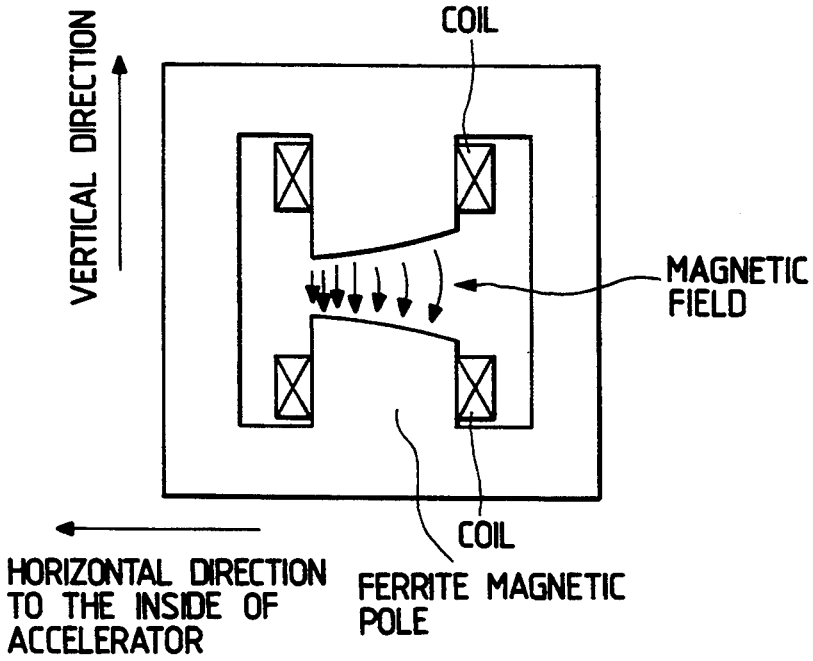
FIG. 10 is a front view of a two-pole electromagnet to be utilized in the fourth embodiment.

A fourth embodiment of the first means of the invention is described with reference to FIG. 9. In the fourth embodiment of the invention, two-pole electromagnets 13 and 14 are installed in a straight line portion of the electron beam orbit, to accelerate damping of betatron oscillation. One two-pole electromagnet 13 is excited so as to direct its magnetic field downward in the perpendicular direction, and the other 14 is excited so as to direct its magnetic field upward in the perpendicular direction. This pair of two-pole electromagnets 13 and 14 have the same structure, and have an opening wider toward the outside in the horizontal directions as shown in FIG. 10. This structure of the horizontal opening produces the same four-pole components as in the four-pole electromagnet in which the magnetic field intensity varies linearly in the x direction. Because of this, the same function as achieved by the above-mentioned four-pole electromagnet 8 can be obtained, thereby effecting damping of the betatron oscillation in a short period of time. In this embodiment, after completion of several beam injections, excitation of the two-pole electromagnets 13 and 14 is decreased in order to facilitate a shift to the operational state in which to accelerate or orbit the beam stably, and at the same time excitation of the four-pole electromagnets 3 is adjusted accordingly.

Figure 11:
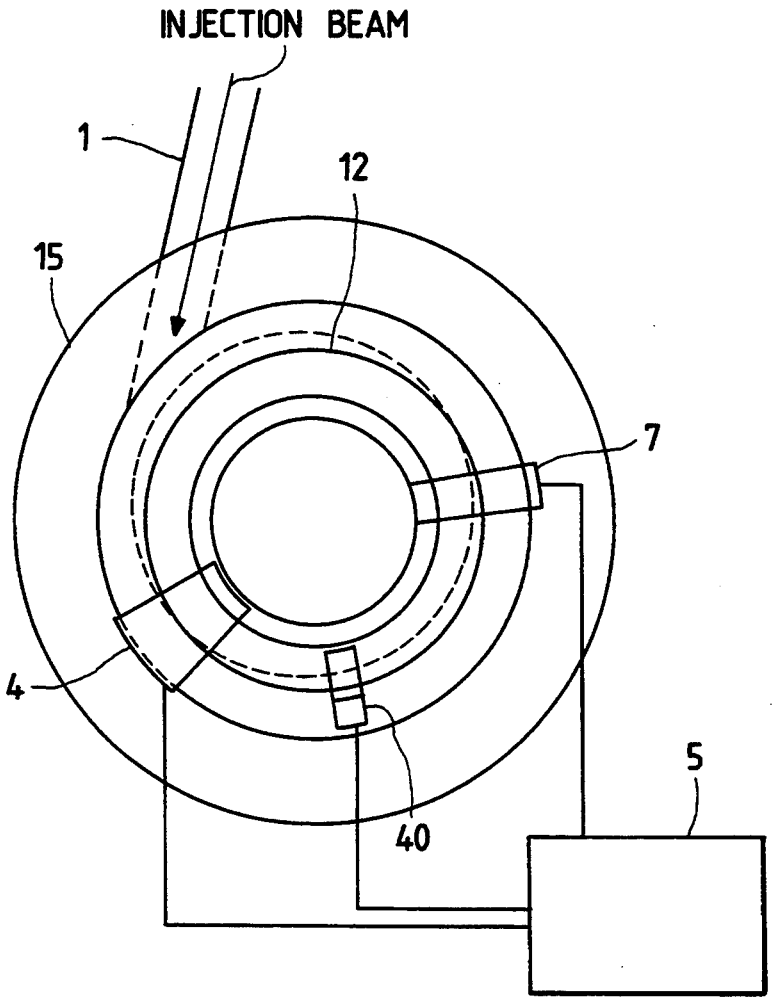
FIG. 11 is a schematic view of an accelerator of a fifth embodiment of the invention.

A fifth embodiment of the first means of the invention is shown in FIG. 11. The preceding four embodiments are examples of the present invention as applied to what is termed a "race-track" type circular accelerator having an orbit shaped like a running track on the ground. This embodiment is an example of the invention as applied to a complete circle type accelerator having an orbit which is completely circular. In an example of this embodiment, after injecting electrons having an energy of 50 MeV, they are accelerated up to 500 MeV and stored. Numeral 15 indicates a bending electromagnet having deflection angles of 360 degrees. Numeral 1 indicates a beam injector. Number 7 indicates a bump electromagnet, which is excited with a sinusoidal current at the time of injection as shown in FIG. 5, to shift a center closed orbit of the beam to a position as shown by dotted lines in FIG. 11, then to restore the same to an initial position as shown by a line 12 which indicates a designed closed orbit. Numeral 40 indicates a coil for generating four-pole electromagnetic fields for damping betatron oscillations, with stronger magnetic field intensities toward the inside in the radial directions. This coil corresponds to the four-pole electromagnet used previously. This is referred to simply as the coil, because its four-pole electromagnet is composed of the magnetic poles of the bending electromagnet 15.

Figure 12:
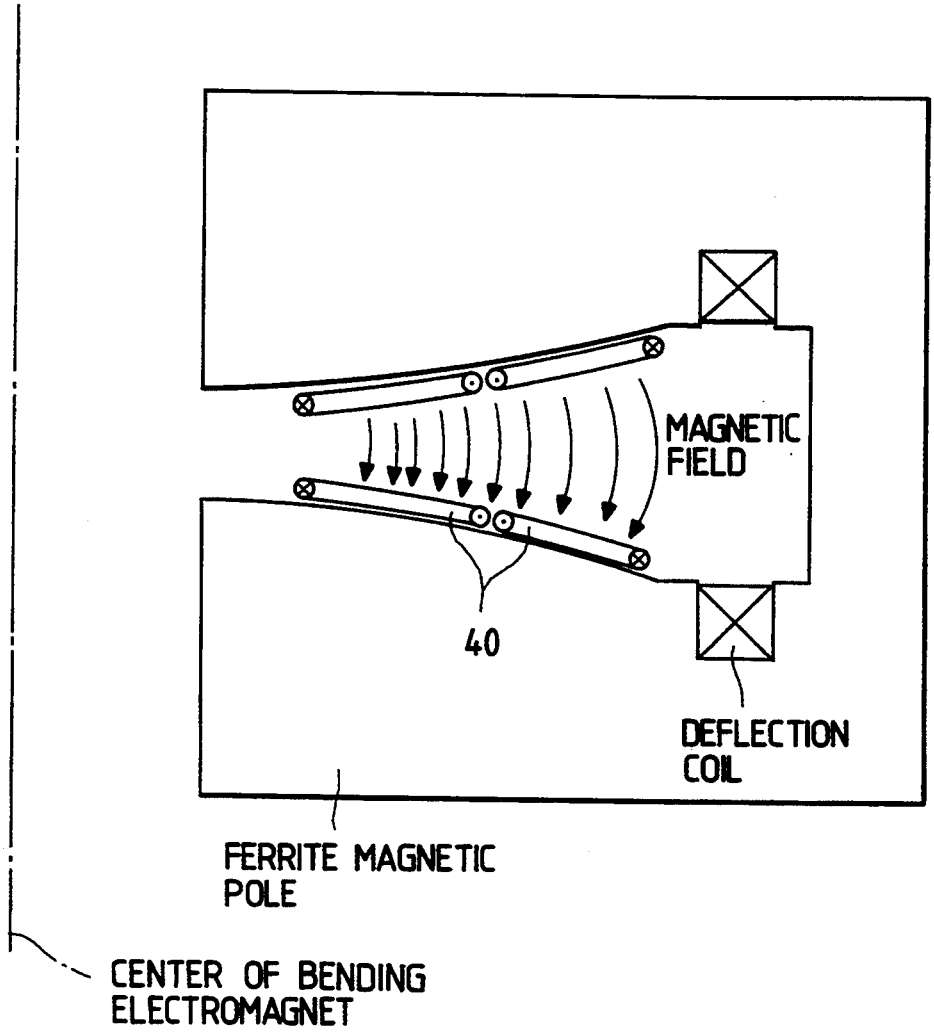
FIG. 12 is a cross-sectional view of a bending electromagnet to be utilized in the fifth embodiment.

A cross-section view in the vertical direction of the coil 40 is shown in FIG. 12. The magnetic poles of the bending electromagnet 15 are disposed in such a manner that the gap between the magnetic poles becomes smaller toward the inside of the radial direction. In this manner, magnetic field gradients in the vertical and horizontal directions are provided, so as to enable the beam to orbit stably. In the gap between the magnetic poles, when the coil 40 is excited, a magnetic field induced is superimposed with a bending electromagnetic field induced by the bending electromagnet 15 therein. In this embodiment, because both magnetic field components of the bending electromagnet and of the coil are superimposed, the center of the magnetic field produced by the coil 40 is not necessarily offset from the line 12.

When the bump electromagnet 7 is excited by a pulse at the time of beam injection, with the bending electromagnetic 15 and the coil 40 for damping betatron oscillations being excited beforehand, the beam center closed orbit shifts from a position indicated by dotted lines in FIG. 11 to a position of the solid line, thus effecting a beam storage. During this period, by excitation of the coil 40, the beam radius is decreased to approximately ½ of it initial state in approximately 0.5 s. Then once again by exciting the bump electromagnet 7 while injecting a beam, a new beam can be stored. After repeating this sequence until a predetermined current value is obtained, excitation of the coil 40 is interrupted to facilitate a shift to the operating conditions optimum for beam storage. During this sequence, a high frequency is supplied continuously from the high frequency acceleration cavity 4, so as to maintain a stable beam orbit. After that, the magnetic field intensity of the bending electromagnet 15 is increased to a value necessary for obtaining a beam of 500 MeV in orbit; hence the energy of the beam increases with an increasing intensity of the bending electromagnetic field up to 500 MeV. By operating the bending electromagnet 15 and high frequency acceleration cavity 4 in this state, the stored beam is maintained in a stable orbit.

As described hereinabove, even in the complete circle type accelerator embodying the invention, the same effect as in the race-track type accelerator can be implemented. Further, the same effect can also be achieved in any other type of accelerators.

Figure 13:
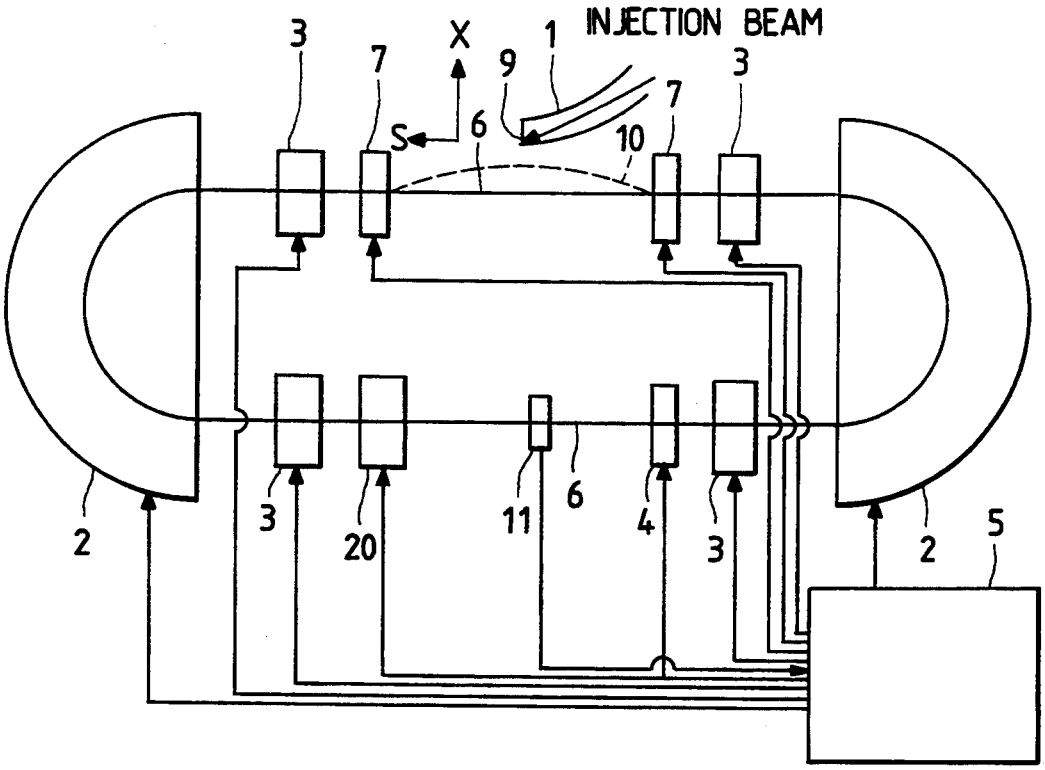
FIG. 13 shows an accelerator of a sixth embodiment of the invention.
Figure 14:
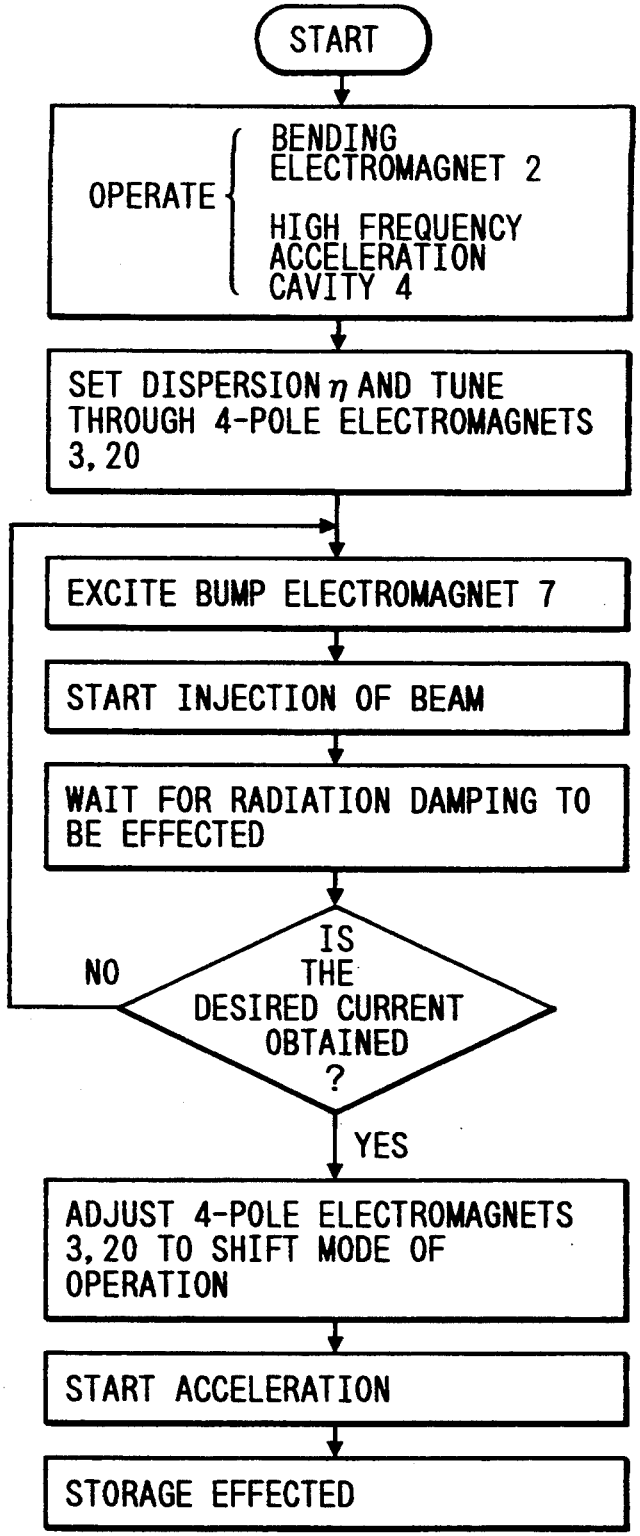
FIG. 14 shows a method of operation of the sixth embodiment of the invention.

Next, a preferred embodiment (a sixth embodiment in consecutive number) of the second means of the present invention is described below. A schematic diagram of a circular accelerator of this embodiment is shown in FIG. 13. In this embodiment, a dispersion function $\eta$ and a tune are varied by means of four-pole electromagnets 3 and a tune-adjustment four-pole electromagnet 20, so as to extend the length of a closed orbit in bending electromagnets 2. An exemplary method of operation of this embodiment is shown in FIG. 14 and a characteristic closed orbit of the beam is shown in FIG. 15.

Figure 15:
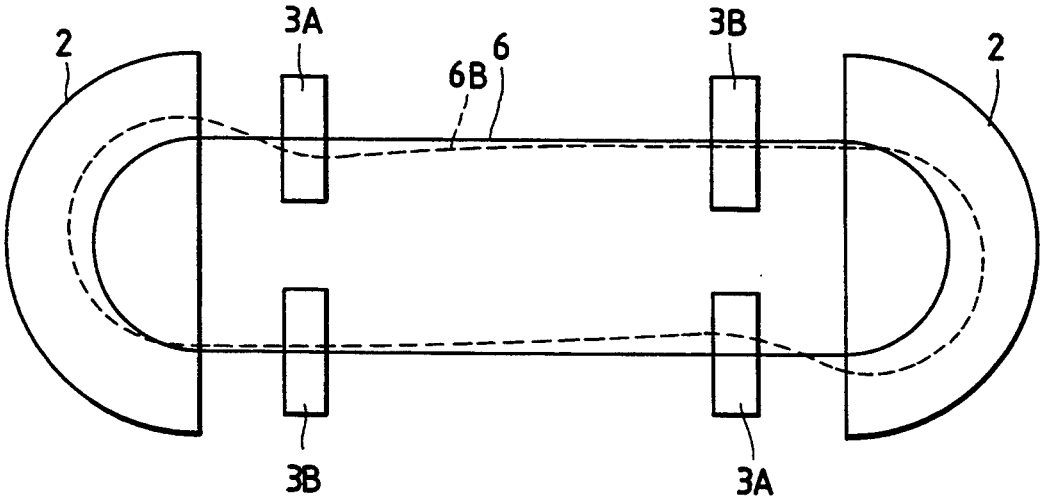
FIG. 15 shows a closed orbit of a beam in the sixth embodiment of the invention.

Bump electromagnet 7, tune-adjustment four-pole electromagnet 20 and the like are omitted in FIG. 15. As shown in FIG. 14, until a number of beam injections are completed, this embodiment is operated by adjusting amounts of excitation of four-pole electromagnets 3 and 20 as referred to in FIG. 14, so that the dispersion function $\eta$ may have a negative region in the bending electromagnet portion 2. That is, as a beam having a lower momentum than the average (for example, $\Delta p<0$) follows a closed orbit inside the center closed orbit as shown by broken lines 6B in FIG. 15, excitation of four-pole electromagnets 3A is controlled so as to kick the beam outwardly. As a result, the beam of $\Delta p<0$ is permitted to traverse the outside of the center closed orbit, following a closed orbit of $x>0$. This indicates that the dispersion function $\eta$ is negative in the bending electromagnet portion 2 as expressed in equation 2.

As can be appreciated from the figure, the closed orbit of a beam having a smaller momentum than the average can be lengthened so as to provide a greater damping effect on the betatron oscillation. On the other hand, a beam having a greater momentum than the average, contrary to the case of broken lines 6B, is kicked inwardly by the four-pole electromagnet 3A, so that its closed orbit becomes shorter. However, as expressed in equation 1, because the radiation damping is proportional to three powers of energy E, the influence of the variation in the length of the closed orbit being smaller in comparison, an enhanced radiation damping effect can be obtained, and the injection period of time at each injection can be reduced substantially. Thus, a large current storage can be achieved through beam injection by the same technique used in the first or the second embodiment of the first means of the present invention, and by repeating the damping of betatron oscillations and injection until a desired current is stored.

In this embodiment, because the amounts of excitation in the four-pole electromagnets 3A are varied at each injection, the tune (defined as the number of betatron oscillations per orbit in the accelerator) also varies, and thus the beam is not always assured of a stable orbit. This is why the tune-adjustment four-pole electromagnet 20 is employed which in combination with the four-pole electromagnet 3B adjusts this tune. Further, when starting injection or moving to the acceleration mode, a balance is maintained between the excitation of the four-pole electromagnets 3 and the tune-adjustment four-pole electromagnet 20, with a tune maintained constant, so as to effect a stable orbit. Once in the acceleration mode or storage mode, it is no longer necessary for the tune-adjustment four-pole electromagnet 20 to be controlled as above. Where it is possible to adjust the variation of the betatron oscillations per round in an accelerator after repeated injections only by the adjustment of the four-pole electromagnets 3, no tune-adjustment four-pole electromagnet 20 is required.

According to this embodiment as described above, not only can the injection time be reduced, but also a large current can be injected. Further, by installing a betatron oscillation damping electromagnet as set forth in the first, second, third and fourth embodiments of the first means of the invention into the circle accelerator of the invention, an even greater damping effect on the betatron oscillations can be achieved, thereby implementing an enhanced effect of the present invention.

Figure 16:
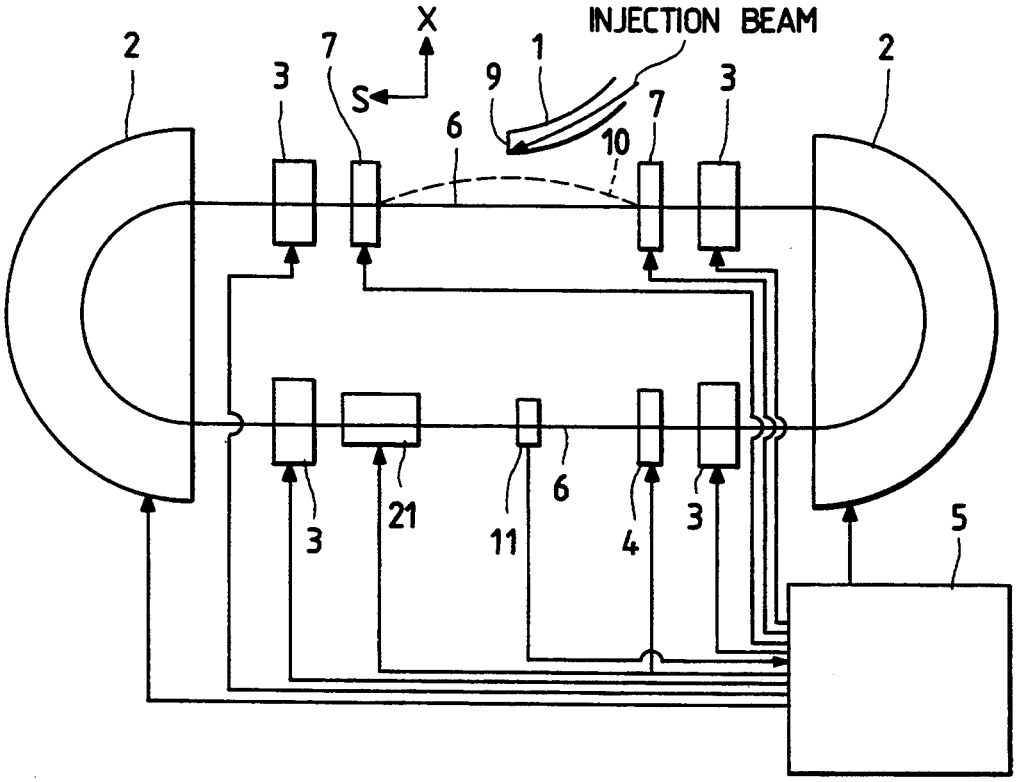
FIG. 16 is a schematic diagram illustrating an accelerator of a seventh embodiment of the invention.

In the last embodiment, a third means of the present invention will be described (seventh embodiment in consecutive number). FIG. 16 illustrates a schematic diagram of a circular accelerator which has a zigzag device, or a wiggler, installed in the straight line portion of an orbit, to guide the beam in a "zigzag" direction. By operating this wiggler 21 at the time of beam injection, radiation damping can be accelerated, thereby effecting a large current injection in a short period of time. Such wigglers can be implemented by arranging a plurality of two-pole magnets in series as set forth with respect to the fourth embodiment. What is different from the two-pole magnets in the fourth embodiment is that the gap between magnetic poles is constant in the horizontal directions. An undulator may be substituted for the wiggler in this embodiment to the same effect.

The present invention can effectively reduce the damping time of a beam size, thus making possible a circular accelerator and a method of injection wherein the injection time is substantially reduced.

Further, even with charged particles having injection energies under 50 MeV, the invention can provide a circular accelerator and a method of injection whereby a large current can be injected in a short period of time.

Lastly, the invention also provides a circular accelerator which is compact in system structure, and is capable of injecting a large current therein.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A circular accelerator comprising:

a beam injector for injecting a beam of charged particles into a closed orbit in said accelerator;

a control unit for said beam injector to inject said beam into said closed orbit during at least one injection cycle of an injection period and to discontinue injection of said beam during at least one waiting cycle of said injection period following said first cycle;

means for increasing a rate of radiation damping of said beam during said injection period; and means for accelerating said beam of charged particles after completion of said injection period.

2. A circular accelerator according to claim 1, wherein said means for increasing a rate of radiation damping comprises an electromagnet arrangement for applying a magnetic field to said beam, and means for increasing intensity of said magnetic field during said injection cycle relative to said intensity during said waiting cycle.

3. A circular accelerator according to claim 2, wherein said electromagnet arrangement comprises a multiple pole electromagnet situated in a path of said closed orbit, at a location which is offset by a predetermined distance relative to said path of said closed orbit.

4. A circular accelerator according to claim 2, wherein said means for increasing a rate of radiation damping comprises a multiple pole electromagnet situated in a path of said closed orbit at a location which is aligned with a center of said path, and means for shifting an orbital path of said beam in a direction of increased magnetic field intensity of said multiple pole electromagnet.

5. A circular accelerator according to claim 4, wherein said means for shifting an orbital path of said beam comprises a high .frequency acceleration cavity for supplying energy to said beam.

6. A circular accelerator according to claim 1, wherein said means for increasing a rate of radiation damping comprises an electromagnet arrangement for applying a magnetic field to said beam and means for lengthening a path of said closed orbit within said magnetic field during said injection cycle relative to length of said path within said magnetic field during said waiting cycle.

7. A circular accelerator according to claim 6, wherein said means for lengthening a path of said closed orbit comprises an energy arrangement of multiple pole electromagnets which shift a path of said beam outwardly, thereby increasing path length of said beam within said magnetic field.

8. A circular accelerator according to claim 1, wherein said means for increasing a rate of radiation damping comprises an electromagnet arrangement for causing said closed orbit to follow a zigzag path during said injection cycle.

9. A circular accelerator comprising:

means for injecting a beam of charged particles into a center closed orbit;

acceleration means for controlling energy of said beam;

control means for controlling an orbital path of said beam injected into said center closed orbit and emission of dampening radiation by said beam, by selectively altering either magnetic field intensity of a magnetic field applied to said beam or an acceleration frequency applied to said beam by said acceleration means, said control means comprising at least one orbit electromagnet that determines said orbital path according to a relationship between a magnetic field intensity of said orbit electromagnet and energy of said beam, and at least one radiation damping electromagnet causing emission of damping radiation by said beam while in said center closed orbit; and means operative only during injection of said beam for increasing a rate of emission of damping radiation by said beam by strengthening magnetic field intensity of a magnetic field applied to said beam during said injection;

wherein a center path of said radiation damping electromagnet and said center closed orbit are offset relative to each other, by a selected distance.

10. A circular accelerator according to claim 6, wherein said offset is created by positioning said radiation damping electromagnet at a location wherein a center path of said radiation damping electromagnet is displaced from said center closed orbit.

11. A circular accelerator according to claim 9, wherein said offset is in a direction such that radiation damping of said beam in increased when said beam loses energy and shifts its orbit.

12. A circular accelerator according to claim 8, wherein said center path of said radiation damping electromagnet is outward of said center closed orbit, and a dispersion function of said beam, at a point where said radiation damping electromagnet is located, is positive.

13. A circular accelerator according to claim 11, wherein said center path of said radiation damping electromagnet is inward of said center closed orbit, and a dispersion function of said beam, at a point where said radiation damping electromagnet is located, is negative.

14. A circular accelerator according to claim 9, wherein said means for increasing a rate of emission of damping radiation comprises means for strengthening said magnetic field intensity during said injection relative to magnetic field intensity after completion of said injection.

15. A circular accelerator according to claim 9, wherein said radiation damping electromagnet generates a magnetic field which has at least four poles.

16. A circular accelerator according to claim 15, wherein said radiation damping electromagnet is a four pole electromagnet.

17. A circular accelerator comprising:

means for injecting a beam of charged particles into a center closed orbit;

acceleration means for controlling energy of said beam;

control means for controlling an orbital path of said beam injected into said center closed orbit and emission of damping radiation by said beam by selectively altering either magnetic field intensity of a magnetic field applied to said beam or an acceleration frequency applied to said beam by said acceleration means; and means, operative only during an injection cycle in which said beam is injected into said center closed orbit, for increasing a rate of emission of damping radiation by said beam;

wherein said means for injecting a beam of charged particles into said center closed orbit is operative during said injection cycle, and is inoperative during a damping cycle.

18. A circular accelerator according to claim 17, wherein said means for increasing a rate of emission of damping radiation is operative during said damping cycle and during said injection cycle.

19. A circular accelerator according to claim 17, wherein said means for increasing a rate of emission of damping radiation comprises means for measuring a current of said beam, and means for repeating said injection and damping cycles for a number of repetitions based on a measured magnitude of said current.

20. Apparatus for a circular acceleration having a closed orbit for a beam of charged particles, comprising:

at least one radiation damping electromagnet, activated only during injection of said beam, for enhancing radiation of said beam; and control means for enhancing said radiation by said radiation damping electromagnet;

wherein said control means is operative during said injection cycle when said beam is injected into said closed orbit, and is in operative during a damping cycle until a dimension of said beam reaches a desired size; and wherein said control means comprises means for detecting a current of said beam and means for causing said injection period and said damping period to be repeated at least once, based on a result of said means for detecting.

21. An apparatus according to claim 20, wherein said control means comprises means for strengthening a magnetic field intensity of said radiation damping electromagnet.

22. An apparatus according to claim 20, wherein each said at least one radiation damping electromagnet has at least two poles.

23. A method of controlling a circular accelerator comprising the steps of:

injecting a beam of charged particles into a closed orbit in said accelerator during a first cycle of an injection period, whereby said beam emits radiation while in said orbit;

discontinuing said injecting at the end of said first cycle;

waiting during a second cycle of said injection period;

increasing a rate of radiation damping during said injection period; and operating said circular accelerator after completion of said injection period.

24. A method according to claim 23, wherein said first and second cycles are repeated at least once during said injection period.

25. A method according to claim 24, wherein said damping is performed continuously during said injection period.

26. A method according to claim 24, wherein said damping is performed intermittently during said injection period, during said second cycle only.

27. A method according to claim 23, wherein said operating step comprises accelerating said beam to a desired energy level.

28. A method according to claim 23, wherein said operating step comprises storage of said beam with a desired energy.

29. A circular accelerator comprising:

a source providing a beam of charged particles;

at least one electromagnet for guiding said beam of charged particles in a closed orbit;

an injector for injecting said beam of charged particles into said closed orbit during an injection period;

damping means, operative only during said injection period, for increasing a rate of damping of betatron oscillation of particles in said particle beam during said injection period, said damping means being operable separately from said at least one electromagnet for guiding said beam; and means for accelerating said beam of charged particles after completion of said injection period.

30. Method of operating a particle accelerator of the type having a source providing a beam of charged particles, at least one electromagnet for controlling said beam of charged particles to follow a closed orbit, means for injecting said beam of charged particles into said closed orbit during an injection period and means for accelerating said beam of charged particles after completion of said injection period, said method comprising:

providing damping means, situated along said closed orbit;

exciting said damping means at first level for increasing a rate of radiation damping during said injection period; and reducing excitation of said damping means to a second level which is lower than said first level, after completion of said injection period.

* * * * *